US008794334B2

(12) United States Patent
June

(10) Patent No.: US 8,794,334 B2
(45) Date of Patent: Aug. 5, 2014

(54) MODULAR SUBSEA COMPLETION

(75) Inventor: David June, Houston, TX (US)

(73) Assignee: Cameron International Corporation, Houston, TX (US)

( * ) Notice: Subject to any disclaimer, the term of this patent is extended or adjusted under 35 U.S.C. 154(b) by 179 days.

(21) Appl. No.: 12/868,546

(22) Filed: Aug. 25, 2010

(65) Prior Publication Data

US 2012/0048567 A1 Mar. 1, 2012

(51) Int. Cl.
*E21B 7/12* (2006.01)

(52) U.S. Cl.
USPC ..... 166/368; 166/363; 166/251.1; 166/347

(58) Field of Classification Search
USPC ..... 166/368, 251.1, 363, 364, 347, 345, 166/344, 85.4, 75.15, 77.51, 88.1, 87.1
See application file for complete search history.

(56) References Cited

U.S. PATENT DOCUMENTS 5,544,707 A 8/1996 Hopper et al.
6,076,605 A * 6/2000 Lilley et al. ..... 166/368
6,082,460 A 7/2000 June
6,520,263 B2 2/2003 June
6,612,368 B2 * 9/2003 Kent et al. ..... 166/75.13
7,331,396 B2 * 2/2008 Reimert et al. ..... 166/368

FOREIGN PATENT DOCUMENTS

WO 2009070400 6/2009
WO 2009070401 6/2009
WO 2009129307 10/2009

* cited by examiner

*Primary Examiner* — Matthew Buck
*Assistant Examiner* — Aaron Lembo
(74) *Attorney, Agent, or Firm* — Chamberlain Hrdlicka

(57) ABSTRACT

A system, in certain embodiments, includes a subsea tree and a tubing spool including a longitudinal bore configured to receive a tubing hanger. The tubing spool also includes a lateral flow passage extending from the longitudinal bore and configured to transfer product to the subsea tree. The subsea tree includes multiple valves each coupled to a structure positioned radially outward from the tubing spool such that the subsea tree does not block a subsea intervention connection or blowout preventer (BOP) access to the longitudinal bore.

22 Claims, 9 Drawing Sheets

MODULAR SUBSEA COMPLETION

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
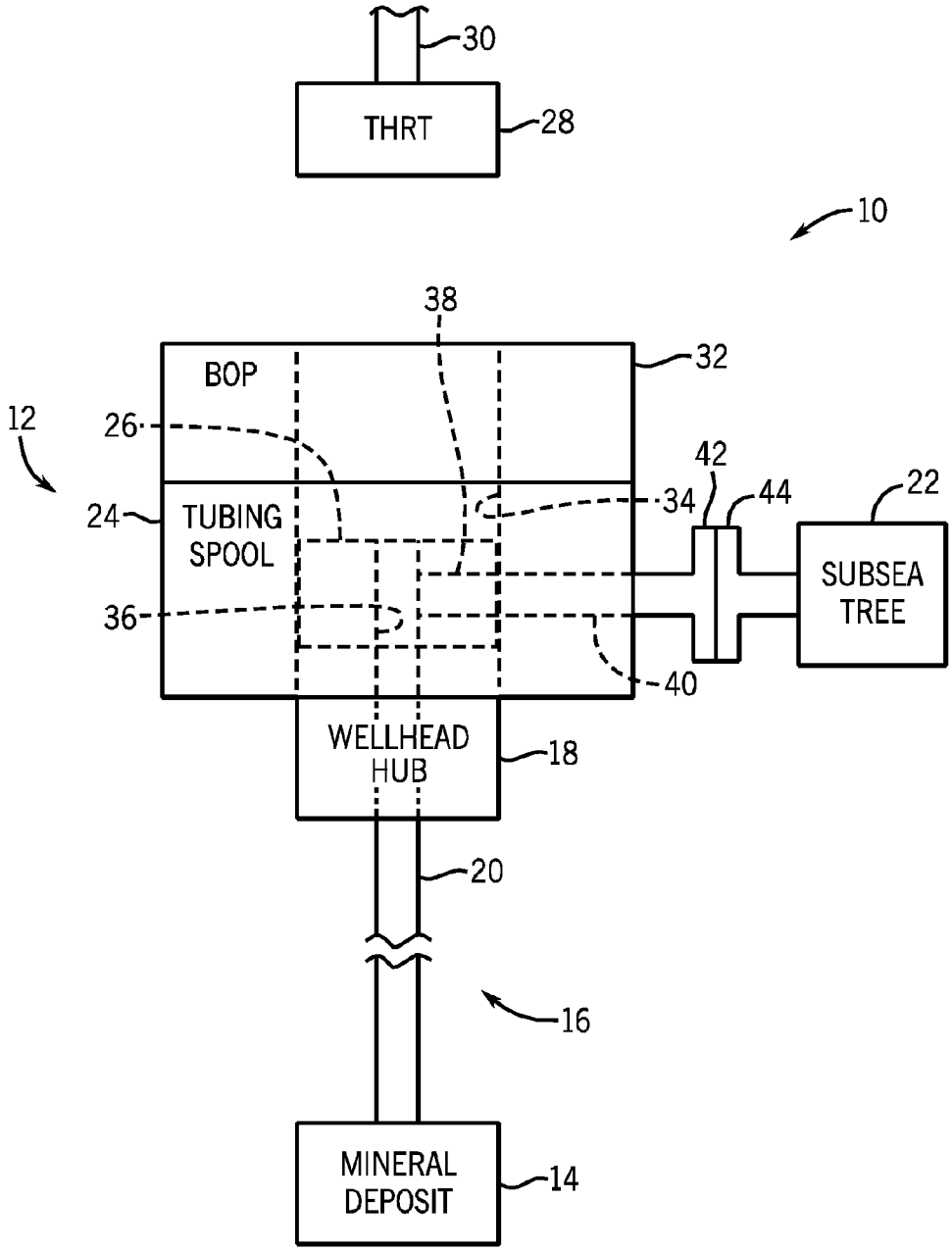
FIG. 1 is a block diagram that illustrates an exemplary mineral extraction system.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Various arrangements of production control valves may be coupled to a wellhead in an assembly generally known as a tree, such as a vertical tree or a horizontal tree. With a vertical tree, after the tubing hanger and production tubing are installed in the wellhead housing, a blowout prevent (BOP) may be removed and the vertical tree may be locked and sealed onto the wellhead. The vertical tree includes one or more production bores containing actuated valves that extend vertically to respective lateral production fluid outlets in the vertical tree. The production bores and production valves are thus in-line with the production tubing.

With a vertical tree, the tree may be removed while leaving the completion (e.g., the production tubing and hanger) in place. However, to pull the completion, the vertical tree must be removed and replaced with a BOP, which involves setting and testing plugs or relying on down-hole valves, which may be unreliable due to lack of use and/or testing. Moreover, removal and installation of the tree and BOP assembly generally requires robust lifting equipment, such as a rig, that may have high daily rental rates, for instance. The well is also in a vulnerable condition while the vertical tree and BOP are being exchanged and neither of these pressure-control devices is in position.

Alternatively, trees with the arrangement of production control valves offset from the production tubing, generally called horizontal trees or spool trees, may be utilized. A spool tree also locks and seals onto the wellhead housing. However, the tubing hanger, instead of being located in the wellhead, locks and seals in the tree bore. After the tree is installed, the tubing string and tubing hanger are run into the tree using a tubing hanger running tool. A production port extends through the tubing hanger, and seals to prevent fluid leakage, thereby facilitating a flow of production fluid into a corresponding production port in the tree. A locking mechanism above the production seals locks the tubing hanger in place in the tree. With the production valves offset from the production tubing, the production tubing hanger and production tubing may be removed from the tree without having to remove the spool tree from the wellhead housing. Unfortunately, if the tree needs to be removed, the entire completion must also be removed, which takes considerable time and also involves setting and testing plugs or relying on down-hole valves, which may be unreliable due to lack of use and/or testing. Additionally, because the locking mechanism on the tubing hanger is above and blocks access to the production port seals, the entire completion must be pulled to service the seals.

To manage expected maintenance costs, which are especially high for an offshore well, an operator may select equipment best suited for the expected type of maintenance. For example, a well operator may predict whether there will be a greater need in the future to pull the tree from the well for repair, or pull the completion, either for repair or for additional work in the well. Depending on the predicted maintenance events, an operator will decide whether the horizontal or vertical tree, each with its own advantages and disadvantages, is best suited for the expected conditions. For instance, with a vertical tree, it is more efficient to pull the tree and leave the completion in place. However, if the completion needs to be pulled, the tree must be pulled as well, increasing the time and expense of pulling the completion. Conversely, with a spool tree, it is more efficient to pull the completion, leaving the tree in place. However, if the tree needs to be pulled, the entire completion must be pulled as well, increasing the time and expense of pulling the tree. The life of the well could easily span 20 years and it is difficult to predict at the outset which capabilities are more desirable for maintenance over the life of the well. Thus, an incorrect prediction may significantly increase the cost of production over the life of the well.

Embodiments of the present disclosure may substantially reduce the duration and costs associated with running and retrieving components of a mineral extraction system, such as a subsea tree, a tubing spool and a tubing hanger. For example, in certain embodiments, a wellhead includes a subsea tree and a tubing spool having a longitudinal bore configured to receive a tubing hanger. The tubing spool also includes a lateral flow passage extending from the longitudinal bore and configured to transfer product to the subsea tree. The subsea tree is positioned radially outward from the tubing spool such that the subsea tree does not block a subsea intervention connection or BOP access to the longitudinal bore. In this configuration, the subsea tree and the tubing hanger may be retrieved independently of one another. In certain embodiments, the subsea tree includes multiple valves coupled to a structure circumferentially disposed about the tubing spool. Such a configuration may facilitate enhanced access to various value actuators via a remote operated vehicle (ROV). In alternative embodiments, the subsea tree may include a structure positioned at one circumferential location radially outward from the tubing spool. Such a tree configuration may include a mating hub connection configured to interface with a hub connection of the tubing spool, thereby facilitating transfer of product (e.g., oil, natural gas, etc.) from the tubing spool to the subsea tree. The hub connection and mating hub connection may interface along a plane substantially perpendicular or substantially parallel to the orientation of the longitudinal bore.

Because the subsea tree is positioned radially outward from the tubing spool, the tree may be run and/or retrieved independently from the tubing hanger. Consequently, to perform maintenance operations on the subsea tree, a ship may be deployed to retrieve the tree. In contrast, if a spool tree were utilized, the tubing hanger must be removed prior to retrieving the tree. Consequently, a rig may be employed to retrieve the tubing hanger and spool tree, thereby significantly increasing tree retrieval costs. Furthermore, in the present embodiment, to perform maintenance operations on the tubing hanger or tubing string, a rig may be deployed to retrieve the tubing hanger while leaving the subsea tree in place. In contrast, if a vertical tree were utilized, the tree must be removed prior to accessing the tubing hanger. Because of the expense associated with deploying a rig, a ship is typically used to retrieve the tree. Therefore, retrieving a tubing hanger from a wellhead employing a vertical tree may involve the coordination of multiple vessels, thereby increasing the costs and duration of maintenance operations.

FIG. 1 is a block diagram that illustrates an exemplary mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20. The wellhead hub 18 generally includes a large diameter hub that is disposed at the termination of the well-bore 20. The wellhead hub 18 provides for the connection of the wellhead 12 to the well 16.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well-bore 20 (down-hole). In the illustrated embodiment, the wellhead 12 includes a subsea tree 22, a tubing spool 24, and a tubing hanger 26. The system 10 may include other devices that are coupled to the wellhead 12, and devices that are used to assemble and control various components of the wellhead 12. For example, in the illustrated embodiment, the system 10 includes a tubing hanger running tool (THRT) 28 suspended from a drill string 30. In certain embodiments, the THRT 28 is lowered (e.g., run) from an offshore vessel to the well 16 and/or the wellhead 12. A blowout preventer (BOP) 32 may also be included, and may include a variety of valves, fittings and controls to block oil, gas, or other fluid from exiting the well in the event of an unintentional release of pressure or an overpressure condition.

As illustrated, the tubing spool 24 is coupled to the wellhead hub 18. Typically, the tubing spool 24 is one of many components in a modular subsea or surface mineral extraction system 10 that is run from an offshore vessel or surface system. The tubing spool 24 includes a longitudinal bore 34 configured to support the tubing hanger 26. In addition, the bore 34 may provide access to the well bore 20 for various completion and workover procedures. For example, components can be run down to the wellhead 12 and disposed in the tubing spool bore 34 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as mandrels, seals, plugs and valves, to control and regulate the well 16. For example, the illustrated tubing hanger 26 is typically disposed within the wellhead 12 to secure tubing suspended in the well bore 20, and to provide a path for hydraulic control fluid, chemical injections, and the like. The hanger 26 includes a longitudinal bore 36 that extends through the center of the hanger 26, and that is in fluid communication with the well bore 20. As illustrated, the hanger 26 also includes a lateral bore 38 in fluid communication with the longitudinal bore 36. The lateral bore 38 of the tubing hanger 26 is configured to transfer product (e.g., oil, natural gas, etc.) from the longitudinal tubing hanger bore 36 to a lateral bore 40 of the tubing spool 24. In the present embodiment, the lateral bore 40 of the tubing spool 24 extends from the longitudinal tubing spool bore 34 to a hub connection 42. The hub connection 42 is configured to interface with a mating hub connection 44 of the subsea tree 22, thereby establishing a flow path from the longitudinal bore 36 of the tubing hanger 26 through the lateral bores 38 and 40 and into the subsea tree 22. While the interface between the hub connection 42 and the mating hub connection 44 is oriented along a plane substantially parallel to the longitudinal bore 34 of the tubing spool 24, it should be appreciated that alternative embodiments may employ an interface along a plane substantially perpendicular to the longitudinal bore 34.

The subsea tree 22 generally includes a variety of flow paths (e.g., bores), valves, fittings, and controls for operating the well 16. For instance, the tree 22 may include a frame, a flow-loop, actuators, and valves. Further, the tree 22 may provide fluid communication with the well 16, such as through the interface between the hub connection 42 and the mating hub connection 44. The subsea tree 22 may also provide for the injection of various chemicals into the well 16 (down-hole), and the like. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities. Because the subsea tree 22 is configured to interface with the tubing spool 24 via the connections 42 and 44, the tree 22 does not include a wellhead connection, thereby enabling the subsea tree 22 to be constructed from thinner, lighter and/or less structurally supportive materials. While the subsea tree 22 is positioned at one circumferential position radially outward from the tubing spool 24 in the present embodiment, alternative embodiments may employ a tree 22 circumferentially disposed about the tubing spool 24.

Because the subsea tree 22 is positioned radially outward from the tubing spool 24, the tree 22 may be run and/or retrieved independently from the tubing hanger 26. For example, the THRT 28 may have direct access to the tubing hanger 26 because the tree 22 does not block the longitudinal tubing spool bore 34. As a result, the tubing hanger 26 may be retrieved without removing the subsea tree 22, thereby substantially reducing the duration and costs associated with retrieving the tubing hanger 26. In addition, because the subsea tree 22 and the tubing spool 24 are separate components, the tree 22 and the tubing spool 24 may be run and/or retrieved independently of one another, thereby further reducing the duration and costs of maintenance operations. Furthermore, because the BOP 32 may be directly coupled to the tubing spool 24, the subsea tree 22 will not experience the bending moments present in vertical tree or spool tree configurations, in which the tree is sandwiched between the BOP 32 and the tubing spool 24 or wellhead hub 18. Consequently, the subsea tree 22 may employ a thinner, lighter and/or less expensive structure. Moreover, because the hub connection 42 and the mating hub connection 44 may be generic/universal, a single subsea tree design may be employed, thereby substantially reducing costs associated with particularly configuring spool trees for various wellhead hub configurations.

Figure 2:
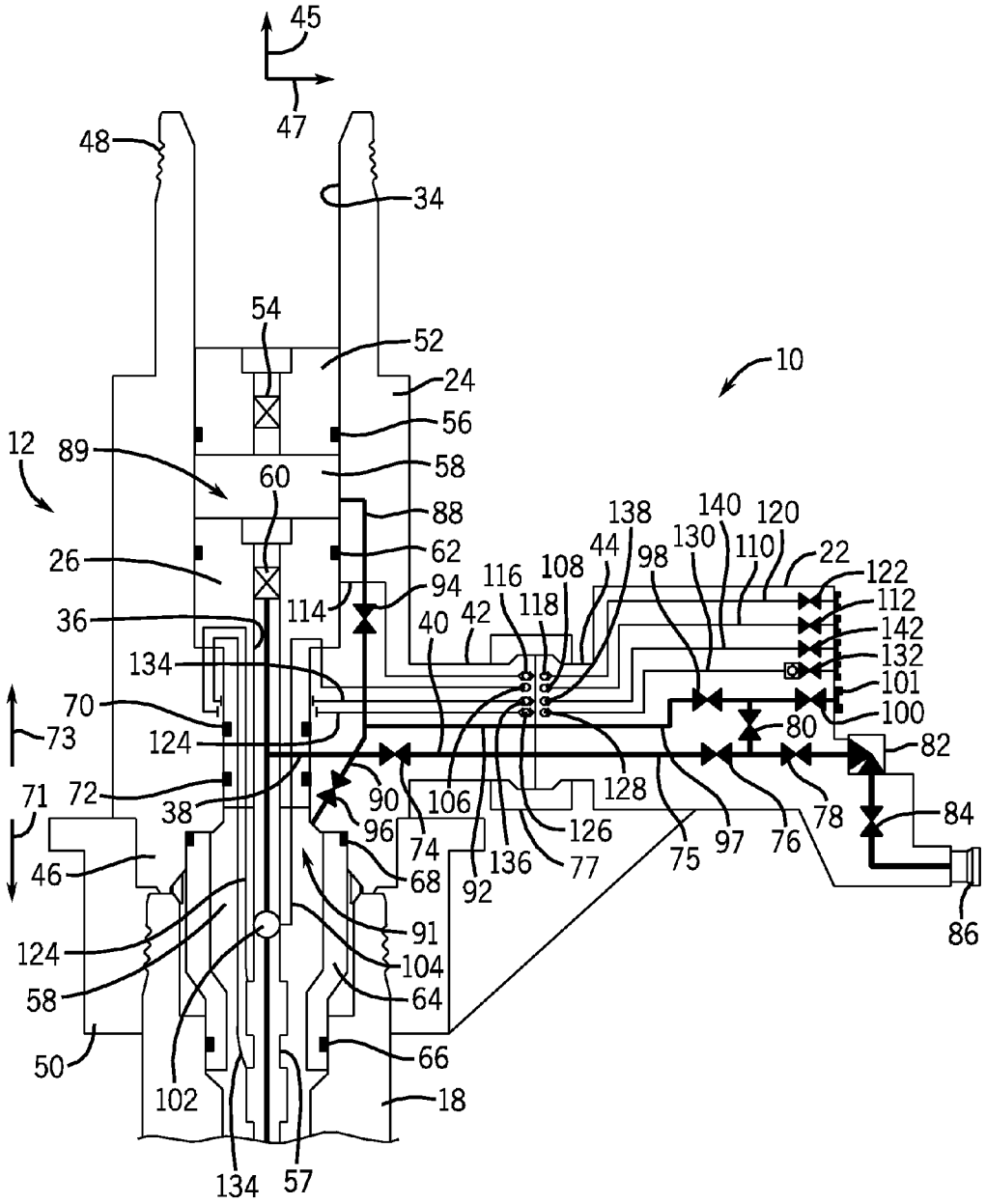
FIG. 2 is a cross-sectional side view of an embodiment of a tubing spool and subsea tree that may be used in the mineral extraction system of FIG.

FIG. 2 is a cross-sectional side view of an embodiment of a tubing spool 24 and subsea tree 22 that may be used in the mineral extraction system 10 of FIG. 1. As previously discussed, the tubing spool 24 is configured to be positioned between the wellhead hub 18 and the BOP 32. Consequently, the tubing spool 24 includes a first end 46 configured to interface with the wellhead hub 18, and a second end 48 configured to interface with the BOP 32. The longitudinal bore 34 extends in an axial direction 45 between the first end 46 and the second end 48, thereby establishing a flow path through the tubing spool 24. In the present embodiment, a collet connector 50 serves to secure the first end 46 of the tubing spool 24 to the wellhead hub 18. In addition, a tree cap 52 is disposed within the longitudinal bore 34 between the tubing hanger 26 and the second end 48 to block fluid flow into and out of the tubing spool 24. As illustrated, the tree cap 52 includes a plug 54, such as a wireline plug, and a seal 56, such as a rubber o-ring, for example. As will be appreciated, the tree cap 52 may include a locking mechanism configured to secure the tree cap 52 to the longitudinal bore 34 of the tubing spool 24. Consequently, the tree cap 52 may be retrieved by releasing the locking mechanism, and then extracting the tree cap 52 from the bore 34. In addition, the plug 54 may be removable (e.g., via a wireline) to provide fluid communication with the longitudinal bore 34.

As previously discussed, the tubing hanger 26 is configured to support a tubing string 57 that extends down the well-bore 20 to the mineral deposit 14. As will be appreciated, an annulus 58 of the tubing spool 24 surrounds the tubing string 57, and may be filled with completion fluid. A plug 60 (e.g., wireline plug) disposed within the longitudinal bore 36 of the tubing hanger 26 serves as a barrier between the product extracted from the mineral deposit 14 and the completion fluid within the annulus 58. Consequently, the plug 60 may block the flow of fluid into and out of the tubing hanger 26. In addition, the tubing hanger 26 includes a seal 62 (e.g., rubber o-ring) disposed against the longitudinal bore 34 of the tubing spool 24 and configured to block fluid flow around the tubing hanger 26. The illustrated wellhead configuration also includes an isolation sleeve 64 disposed within the bore 34, and extending from the first end 46 of the tubing spool 24 to the wellhead hub 18. As illustrated, the isolation sleeve 64 includes a first seal 66 (e.g., rubber o-ring) in contact with the bore of the wellhead hub 18, and a second seal 68 (e.g., rubber o-ring) in contact with the bore 34 of the tubing spool 24. In this configuration, the isolation sleeve 64 may facilitate pressure testing of the seal between the wellhead hub 18 and the tubing spool 24. The isolation sleeve 64 may also serve as an additional barrier to block a flow of completion fluid from exiting the wellhead 12 through the interface between the tubing spool 24 and the wellhead hub 18.

Furthermore, the tubing hanger 26 includes a first seal 70 positioned adjacent to the bore 34 of the tubing spool 24, and located in a downward direction 71 from the lateral flow passage 38. The tubing hanger 26 also includes a second seal 72 positioned adjacent to the bore 34, and located in an upward direction 73 from the lateral flow passage 38. In the present embodiment, the seals 70 and 72 are configured to block flow of completion fluid into the lateral flow passage 38, and to block flow of product (e.g., oil and/or natural gas) into the annulus 58. Consequently, a flow path will be established between the tubing string 57 and the lateral flow passage 40 of the tubing spool 24, thereby facilitating the flow of product to the subsea tree 22. Specifically, product will flow from the tubing string 57 in the upward direction 73 into the longitudinal bore 36 of the tubing hanger 26. Because the plug 60 blocks the flow of product from exiting the tubing hanger 26, the product will be directed through the lateral flow passage 38 of the tubing hanger 26 and into the lateral flow passage 40 of the tubing spool 24. The product will then flow into the subsea tree 22 via the interface between the hub connection 42 and the mating hub connection 44. While the plug 60 serves to block the flow of product out of the tubing hanger 26, it should be appreciated that the plug 54 within the tree cap 52 serves as a backup seal to block product from exiting the tubing spool 24, thereby providing a dual barrier between the product and the environment.

In the present embodiment, the tubing spool 24 includes a production valve 74 coupled to the lateral flow passage 40. The production valve 74 is configured to control the flow of product between the tubing spool 24 and the tree 22. For example, the production valve 74 may be closed prior to retrieving the tree 22, thereby blocking the flow of product from entering the environment. Conversely, once the tree 22 has between run or lowered into position, the valve 74 may be opened to facilitate product flow to the subsea tree 22. While the present embodiment includes a valve 74, it should be appreciated that alternative embodiments may employ any suitable device (e.g., wireline plug) configured to substantially block production flow from the well 16 to the hub connection 42. As illustrated, with the hub connection 42 coupled to the mating hub connection 44, the lateral flow passage 40 of the tubing spool 24 is in fluid communication with a product flow passage 75 of the subsea tree 22. In the present embodiment, the hub connection 42 is coupled to the mating hub connection 44 with a clamp 77, such as a manual clamp or a hydraulic connector. Because the tree 22 is positioned radially outward (i.e., along the radial direction 47) from the tubing spool 24, the subsea tree 22 will not experience the bending moments present in vertical tree or spool tree configurations, in which the tree is sandwiched between the BOP 32 and the tubing spool 24 or wellhead hub 18. Consequently, a smaller and/or lighter clamp 77 may be employed, as compared to vertical tree or spool tree configurations. In addition, alternative embodiments may utilize other connectors, such as latches or fasteners, to secure the hub connection 42 to the mating hub connection 44.

In the present embodiment, the product flow passage 75 includes a first production valve 76 and a second production valve 78. As illustrated the first production valve 76 is positioned upstream of an annulus crossover valve 80, and the second production valve 78 is positioned downstream from the annulus crossover valve 80. As discussed in detail below, the valves 76, 78 and 80 may be controlled to vary fluid flow into and out of the annulus 58 and tubing string 57. In addition, the product flow passage 75 includes a choke 82 positioned downstream from the production valves 76 and 78, and configured to regulate pressure and/or flow rate of product through the product flow passage 75. The product flow passage 75 also includes a flowline isolation valve 84 configured to selectively block fluid flow between the tree 22 and the surface. As illustrated, the product flow passage 75 terminates at a flowline hub 86 configured to interface with a conduit or manifold that conveys the product from the wellhead 12 to a surface vessel or platform.

Because the tubing hanger 26 is substantially sealed to the bore 34 of the tubing spool 24 via the seals 62, 70 and 72, flow of completion fluid through the annulus 58 is blocked. Consequently, the tubing spool 24 includes an upper annuls flow passage 88 and a lower annulus flow passage 90 to regulate completion fluid pressure within an upper region 89 above the tubing hanger 26 and a lower region 91 below the tubing hanger 26, respectively. Specifically, the upper annulus flow passage 88 extends from the upper region 89 to a lateral flow passage 92, and the lower annulus flow passage 90 extends from the lateral flow passage 92 to the lower region 91. In this configuration, completion fluid may be supplied and/or removed from each region 89 and 91 of the annulus 58. In the present embodiment, the upper annulus flow passage 88 includes an upper annulus valve 94, and the lower annulus flow passage 90 includes a lower annulus valve 96. The valves 94 and 96 are configured to control fluid flow to the upper region 89 and lower region 91, respectively. For example, prior to retrieving the tree 22, the valves 94 and 96 may be closed to block the flow of completion fluid from the annulus 58 into the environment. Conversely, once the tree 22 has between run or lowered into position, the valves 94 and 96 may be opened to facilitate flow of completion fluid between the tree 22 and the tubing spool 24. In addition, when landing the tree cap 52, the lower annulus valve 96 may be closed to seal completion fluid within the lower region 91, and the upper annulus valve 94 may be opened to enable excess completion fluid to be drained from the upper region 89, thereby facilitating movement of the tree cap 52 in the downward direction 71.

As illustrated, the lateral annulus flow passage 92 extends through the hub connection 42 and interfaces with an annulus flow passage 97 of the subsea tree 22, thereby establishing a completion fluid flow path between the tubing spool 24 and the subsea tree 22. In the present embodiment, the annulus flow passage 97 includes an annulus valve 98 positioned upstream of the annulus crossover valve 80, and an annulus monitor valve 100 positioned downstream from the annulus crossover valve 80. As will be appreciated, the annulus valves 98 and 100 may be controlled along with the production valves 76 and 78 and the annulus crossover valve 80 to adjust fluid flow to and from the annulus 58 and the tubing string 57. For example, if the annulus valve 98, the annulus monitor valve 100, the first production valve 76, and the second production valve 78 are in the open position, and the annulus crossover valve 80 is in the closed position, then a fluid connection will be established between the flowline hub 86 and the tubing string 57, and between an annulus junction 101 and the annulus 58. In this configuration, pressure within the annulus 58 may be monitored, increased and/or decreased from the surface, and product may flow to a surface vessel or platform through the flowline hub 86. In one alternative configuration, the annulus monitor valve 100, the annulus crossover valve 80 and the first production valve 76 may be transitioned to the open position, and the annulus valve 98 and the second production valve 78 may be transitioned to the closed position. As a result, product flow to the flowline hub 86 will be blocked. However, a fluid connection will be established between the annulus junction 101 and the tubing string 57. In this configuration, completion fluid may be pumped into the tubing string 57 and/or the pressure of the product may be measured. As will be appreciated, the valves 76, 78, 80, 98 and 100 may be transitioned to alternative positions to establish further flow path configurations.

In the present embodiment, the tubing string 57 includes a surface-controlled subsurface safety valve (SCSSV) 102 configured to selectively block product flow to the subsea tree 22. The present SCSSV 102 is hydraulically operated, and biased toward a closed position (i.e., failsafe closed) to ensure that the SCSSV 102 closes if the system experiences a reduction in hydraulic pressure. With the SCSSV 102 and the production valve 74 in respective closed positions, two barriers are provided between the product flow and the environment, even when the tree 22 is removed. In the present embodiment, the SCSSV 102 is hydraulically controlled via a conduit 104 extending from the hub connection 42 to the SCSSV 102. As illustrated, the conduit 104 terminates at a stab connector 106. The stab connector 106 is configured to interface with a corresponding stab connector 108 within the mating hub connection 44 of the subsea tree 22. In this configuration, when the hub connection 42 is mounted to the mating hub connection 44, the stab connectors 106 and 108 engage one another, thereby establishing a fluid connection between the conduit 104 within the tubing spool 24 and a conduit 110 within the subsea tree 22. The stab connectors 106 and 108 may also be configured to substantially block fluid flow into and out of the respective conduits 104 and 110 when the stab connectors 106 and 108 are disengaged. As illustrated, the conduit 110 is coupled to a valve 112 configured to selectively block hydraulic fluid flow to the SCSSV 102.

In the present embodiment, the tubing spool 24 also includes a vent/test conduit 114 configured to regulate fluid flow to certain regions of the tubing hanger 26. For example, during running operations, fluid may become trapped between various seals of the tubing hanger 26, thereby blocking movement of the hanger 26 in the downward direction 71. In such a situation, the vent/test conduit 114 may vent fluid from the affected region to enable the tubing hanger 26 to land properly within the bore 34 of the tubing spool 24. In addition, the vent/test conduit 114 may provide fluid flow to certain regions between the seals, thereby testing the integrity of the seals. As illustrated, the conduit 114 terminates at a stab connector 116. The stab connector 116 is configured to interface with a corresponding stab connector 118 within the mating hub connection 44 of the subsea tree 22. In this configuration, when the hub connection 42 is mounted to the mating hub connection 44, the stab connectors 116 and 118 engage one another, thereby establishing a fluid connection between the conduit 114 within the tubing spool 24 and a conduit 120 within the subsea tree 22. The stab connectors 116 and 118 may also be configured to substantially block fluid flow into and out of the respective conduits 114 and 120 when the stab connectors 116 and 118 are disengaged. As illustrated, the conduit 120 is coupled to a valve 122 configured to selectively block fluid flow to the vent/test conduit 114.

In the present embodiment, the tubing spool 24 also includes a chemical injection conduit 124 configured to inject chemicals, such as methanol, polymers, surfactants, etc., into the well-bore 20 to improve recovery. As illustrated, the conduit 124 terminates at a stab connector 126. The stab connector 126 is configured to interface with a corresponding stab connector 128 within the mating hub connection 44 of the subsea tree 22. In this configuration, when the hub connection 42 is mounted to the mating hub connection 44, the stab connectors 126 and 128 engage one another, thereby establishing a fluid connection between the conduit 124 within the tubing spool 24 and a conduit 130 within the subsea tree 22. The stab connectors 126 and 128 may also be configured to substantially block fluid flow into and out of the respective conduits 124 and 130 when the stab connectors 126 and 128 are disengaged. As illustrated, the conduit 130 is coupled to a valve 132 configured to selectively block the flow of chemicals into the well-bore 20.

In the present embodiment, the tubing spool 24 also includes another hydraulic conduit 134 configured to operate a sliding sleeve within the tubing string 57. For example, the tubing string 57 may terminate in a first region of the mineral deposit 14 and the sliding sleeve may be aligned with a second region of the mineral deposit 14. In this configuration, when the sliding sleeve is in a closed position, the tubing string 57 may extract product from the first region. Conversely, when the sliding sleeve is in an open position, the tubing string 57 may extract product from the second region. Consequently, product may be selectively extracted from various regions of the mineral deposit 14 with a single tubing string 57. As illustrated, the conduit 134 terminates at a stab connector 136. The stab connector 136 is configured to interface with a corresponding stab connector 138 within the mating hub connection 44 of the subsea tree 22. In this configuration, when the hub connection 42 is mounted to the mating hub connection 44, the stab connectors 136 and 138 engage one another, thereby establishing a fluid connection between the conduit 134 within the tubing spool 24 and a conduit 140 within the subsea tree 22. The stab connectors 136 and 138 may also be configured to substantially block fluid flow into and out of the respective conduits 134 and 140 when the stab connectors 136 and 138 are disengaged. As illustrated, the conduit 140 is coupled to a valve 142 configured to selectively block hydraulic fluid flow to the sliding sleeve. While the present embodiment includes four conduits 104, 114, 124 and 134 extending from the subsea tree 22 to the tubing spool 24, it should be appreciated that alternative embodiments may include more or fewer conduits. For example, certain embodiments may include additional valves controlled by additional hydraulic conduits, additional sliding sleeves controlled by additional conduits and/or additional chemical injection conduits.

As previously discussed, the present wellhead configuration enables the subsea tree 22 to be run and/or retrieved independently from the subsea tree 22. For example, to remove the tree 22, the SCSSV 102 and the production valve 74 may be transitioned to the closed position, thereby blocking a flow of product out of the tubing spool 24. In addition, the upper and lower annulus valves 94 and 96 may be transitioned to the closed position to block the flow of completion fluid out of the tubing spool 24. Next, the clamp 77 may be removed, thereby enabling the hub connection 42 and the mating hub connection 44 to separate from one another. Because the conduits 104, 114, 124 and 134 employ stab connectors 106, 116, 126 and 136, respectively, fluid flow into and out of the conduits will be blocked once the tree 22 is removed. Consequently, the tree 22 may be retrieved without substantial fluid leakage from the tubing spool 24. Because most of the valves configured to regulate flow to and from the wellhead 12 (e.g., all valves except the upper annulus valve 94, lower annulus valve 96 and production valve 74) are located within the subsea tree 22, the valves may be serviced without removing the tubing spool 24. Therefore, if valve maintenance is desired, the tree 22 may be pulled by a ship, thereby substantially reducing maintenance costs compared to spool tree configurations in which a rig is employed to retrieve the spool tree.

Similarly, the tubing hanger 26 may be retrieved without removing the subsea tree 22. For example, to remove the tubing hanger 26, the well-bore 20 may be plugged to block the flow of product into the environment. Next, the tree cap 52 may be removed to provide access to the tubing hanger 26. Finally, the tubing hanger 26 and attached tubing string 57 may be retrieved via a rig, for example. Because the subsea tree 22 does not block access to the longitudinal bore 34 of the tubing spool 24, the tree 22 may remain attached to the spool 24 during the tubing hanger retrieval process. Consequently, maintenance costs may be significantly reduced compared to vertical tree configurations in which the vertical tree is removed prior to accessing the tubing hanger 26.

Figure 3:
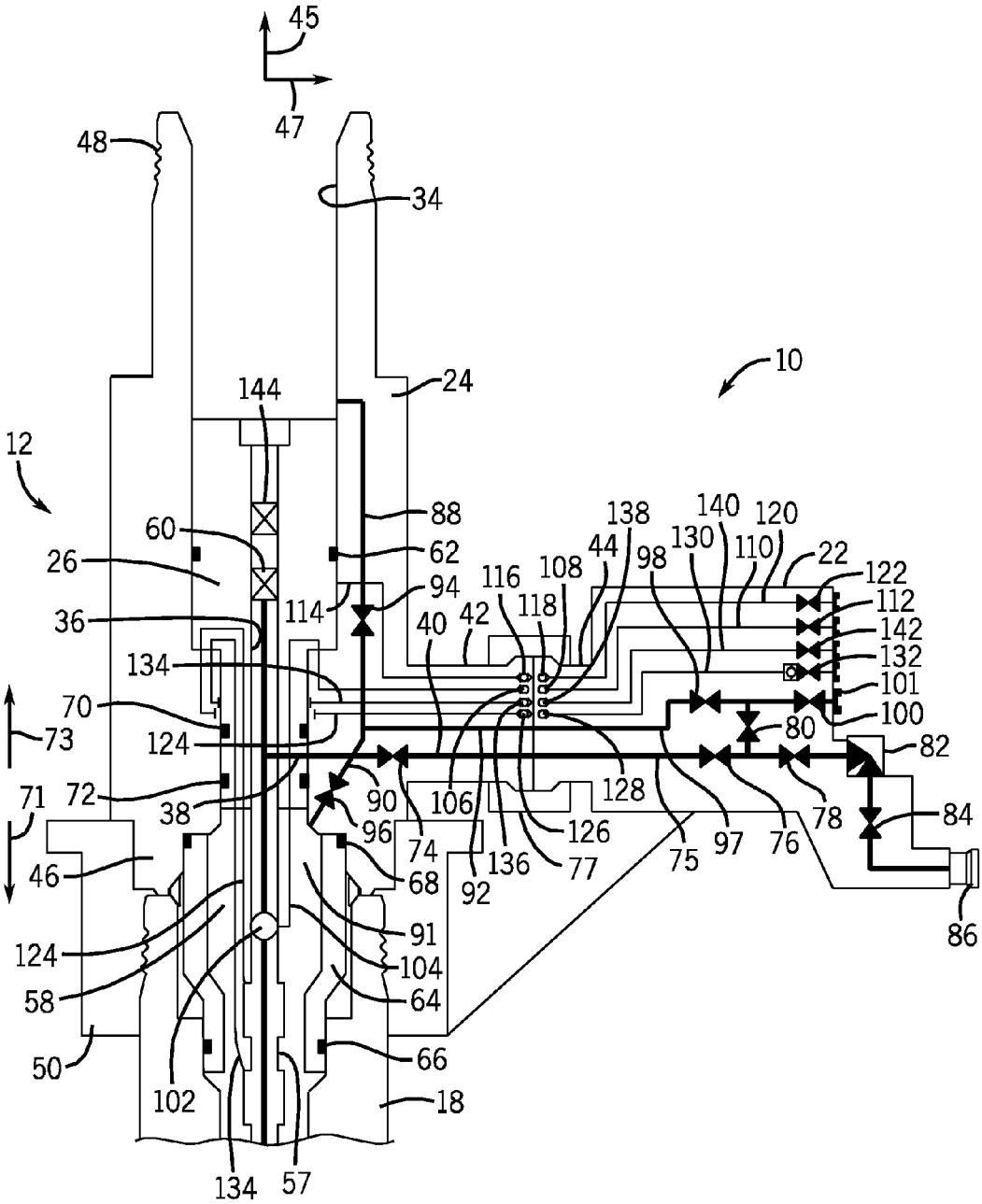
FIG. 3 is a cross-sectional side view of the tubing spool and subsea tree, as shown in FIG. 2, including two plugs within a tubing hanger.

FIG. 3 is a cross-sectional side view of the tubing spool 24 and subsea tree 22, as shown in FIG. 2, including two plugs within the tubing hanger 26. As illustrated, the tree cap 52 of the embodiment described above with reference to FIG. 2 has been replaced by a second plug 144 (e.g., wireline plug). In the present embodiment, the longitudinal bore 36 of the tubing hanger 26 has been extended along the axial direction 45 to accommodate the addition plug 144. The combination of the first plug 60 and the second plug 144 provides a dual barrier between the product flow and the environment. Consequently, the tree cap 52 and plug 54 shown in FIG. 2 may be obviated. Because the tubing hanger 26 is directly exposed to sea water in the present embodiment, the upper annulus flow passage 88 will not be in fluid communication with completion fluid once the tubing hanger 26 has been run. Therefore, the upper annulus valve 94 will be transitioned to the closed position after the tubing hanger running process is complete.

Figure 4:
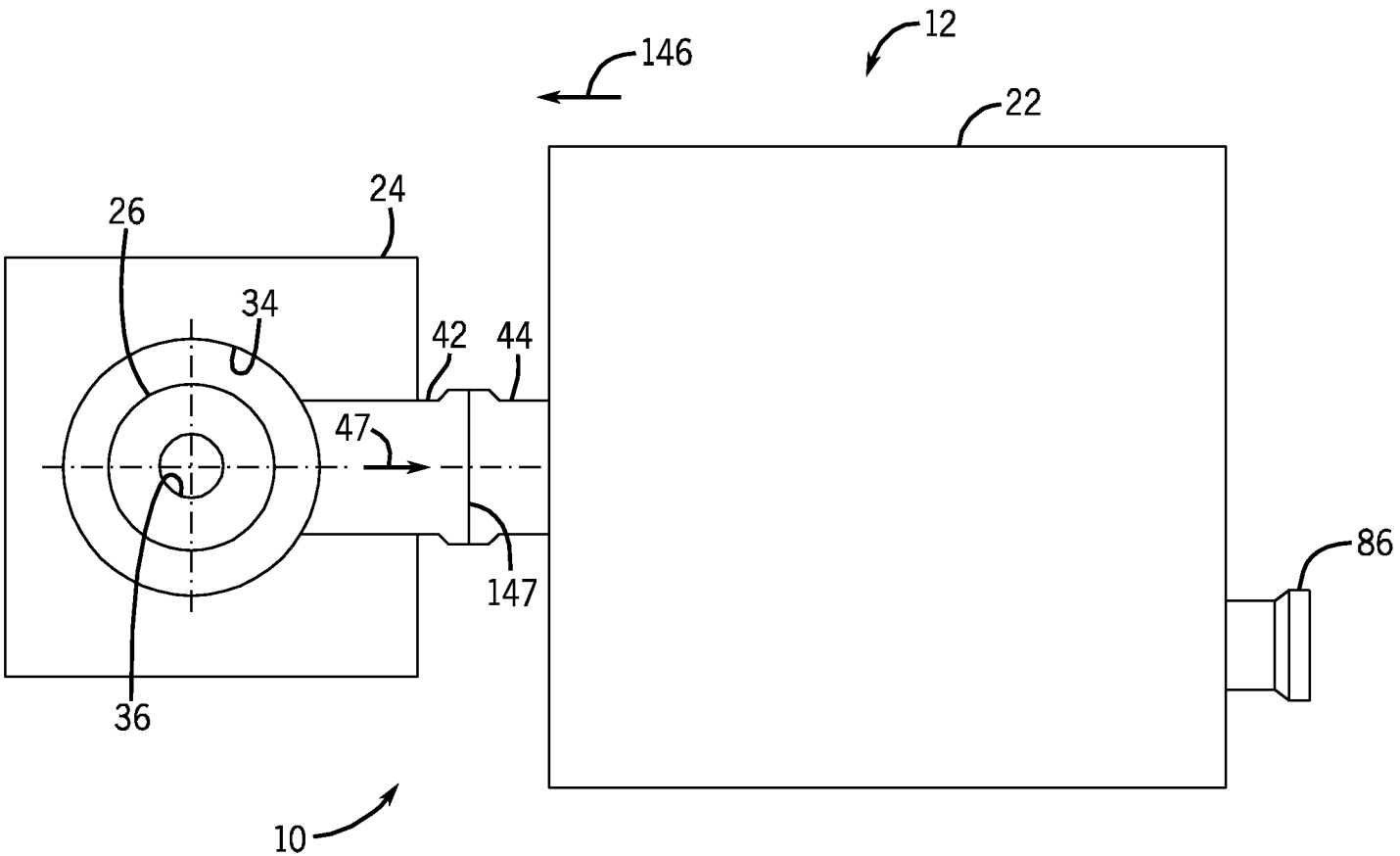
FIG. 4 is a top view of the tubing spool and subsea tree shown in FIG. 2.

FIG. 4 is a top view of the tubing spool 24 and subsea tree 22 shown in FIG. 2. As illustrated, the subsea tree 22 is positioned radially outward (i.e., along the radial direction 47) from the tubing spool 24 such that the subsea tree 22 does not block the longitudinal bore 34. Consequently, the subsea tree 22 and the tubing hanger 26 may be run and/or retrieved independently of one another. In the present embodiment, the hub connection 42 and the mating hub connection 44 are configured to interface with one another along a plane 147 substantially parallel to the longitudinal bore 34 of the tubing spool 24. Consequently, to couple the subsea tree 22 to the tubing spool 24, the tree 22 may be lowered to the depth of the tubing spool 24 and then translated in a lateral direction 146 until the hub connection 42 interfaces with the mating hub connection 44. The hub connection 42 may then be clamped to the mating hub connection 44, thereby establishing the fluid connections described above with reference to FIG. 2.

In certain embodiments, the tubing spool 24 may be configured to interface with a particular wellhead hub 18, while employing a generic/universal hub connection 42. For example, a wide variety of tubing spools 24 may be manufactured to interface with different wellhead hub sizes and/or shapes. However, each tubing spool 24 may employ a substantially identical hub connection 42. Consequently, each subsea tree 22 may employ a mating hub connection 44 configured to interface with the generic/universal hub connection 42. As a result, a single tree design may be utilized for a variety of tubing spool configurations, thereby substantially reducing the expense and/or duration of manufacturing subsea trees 22. In addition, because the subsea tree 22 does not directly interface with the wellhead hub 18, the tree 22 may omit the isolation sleeves and special seals configured to interface with numerous wellhead profiles, thereby further decreasing manufacturing costs.

Figure 5:
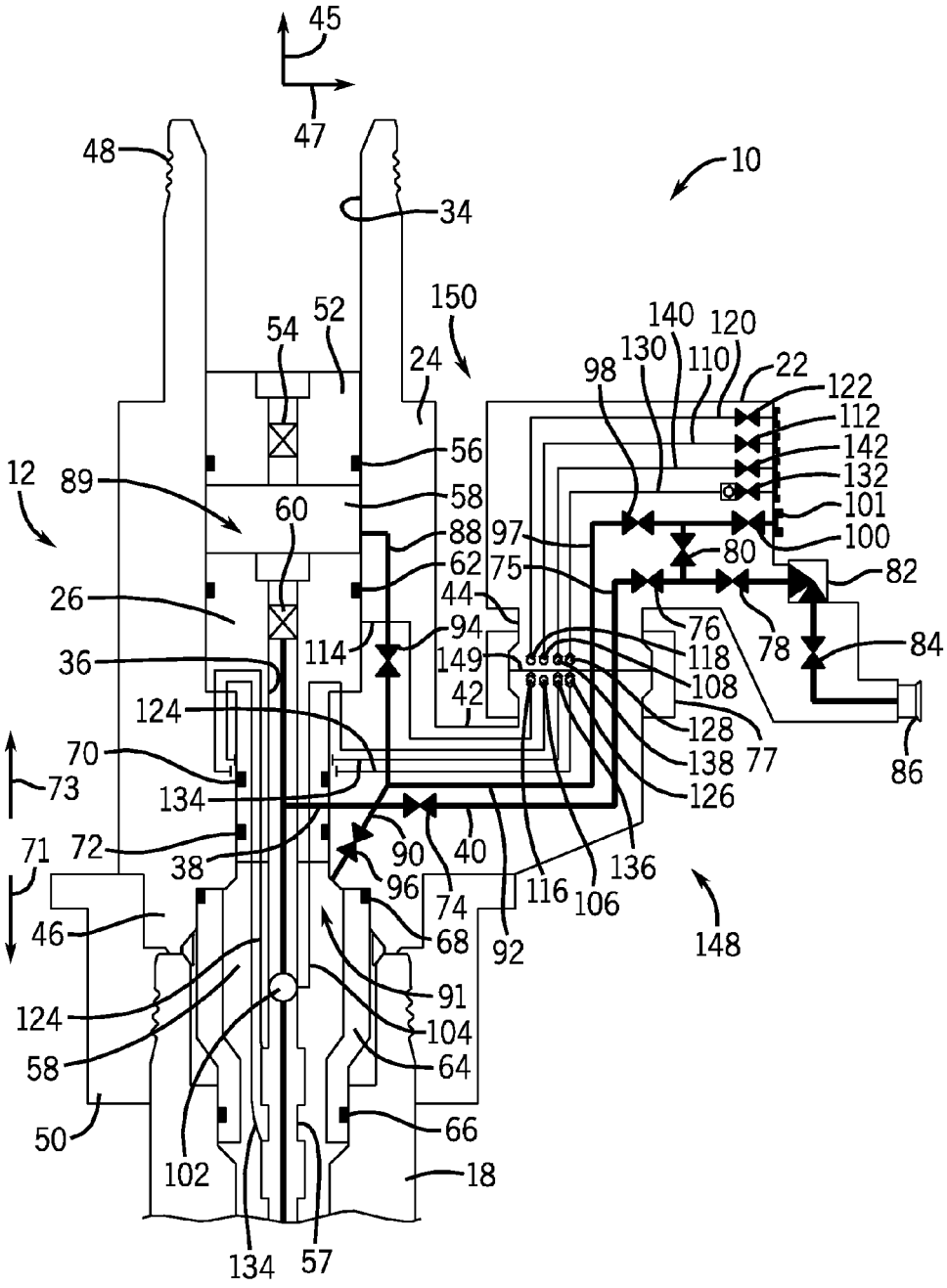
FIG. 5 is a cross-sectional side view of an embodiment of the tubing spool and subsea tree that may be used in the mineral extraction system of FIG. 1.

FIG. 5 is a cross-sectional side view of an embodiment of the tubing spool 24 and subsea tree 22 that may be used in the mineral extraction system 10 of FIG. 1. As illustrated, the hub connection 42 includes a substantially 90 degree bend 148 in the upward direction 73. Correspondingly, the mating hub connection 44 includes a substantially 90 degree bend 150 in the downward direction 71. As a result, the hub connection 42 interfaces the mating hub connection 44 along a plane 149 substantially perpendicular to the longitudinal bore 34 of the tubing spool 24. In this configuration, during the running process, the tree 22 may be lowered into position without the lateral movement described above with reference to the embodiment of FIGS. 2-4. As a result, the duration of the lowering process may be reduced, thereby substantially decreasing assembly costs. While a tree cap 52 is employed in the present embodiment, it should be appreciated that alternative embodiments may employ a tubing hanger 26 with a dual-plug configuration, such as the hanger 26 described above with reference to FIG. 3.

Figure 6:
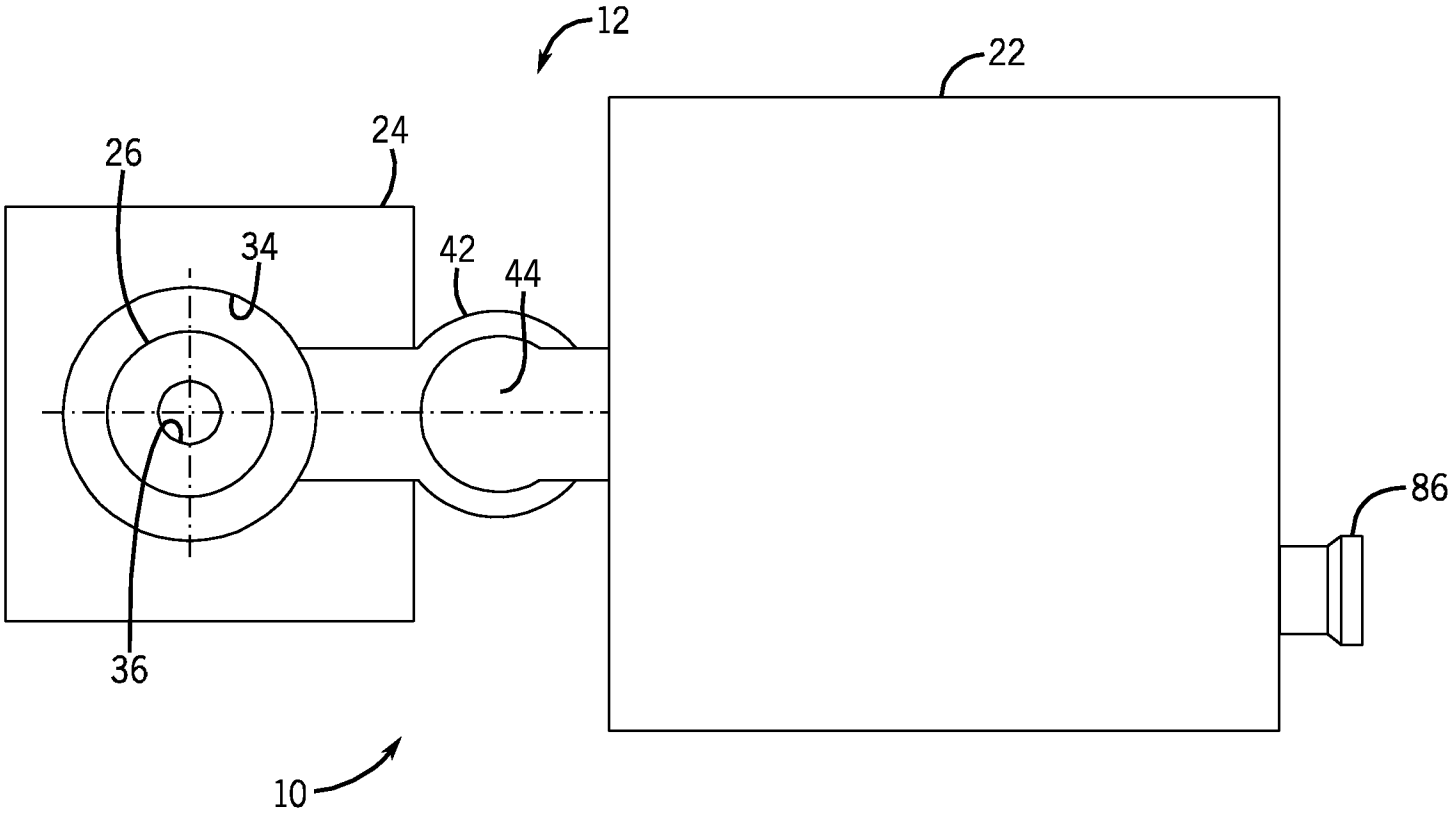
FIG. 6 is a top view of the tubing spool and subsea tree shown in FIG. 5.

FIG. 6 is a top view of the tubing spool 24 and subsea tree 22 shown in FIG. 5. As illustrated, the mating hub connection 44 is positioned above the hub connection 42, thereby enabling the tree 22 to be lowered into position without lateral movement. Consequently, the lowering operation may utilize less time and/or provide decreased costs compared to the embodiment described above with reference to FIGS. 2-4. Furthermore, it should be noted that because the subsea tree 22 is positioned radially outward from the tubing spool 24, the tree 22 and tubing hanger 26 may be run and/or retrieved independently of one another. In addition, because the subsea tree 22 does not include a longitudinal bore, the structure of the tree 22 may be thinner and/or lighter than vertical or horizontal tree configurations. Moreover, because the subsea tree 22 does not interface with a BOP 32 or a wellhead hub 18, the respective connectors may be omitted, thereby further decreasing the weight and/or expensive of the subsea tree 22. For example, due to the complexity and size of certain subsea tree configurations (e.g., spool trees), manufacturing may be restricted to a limited number of facilities in the world. As a result, such facilities may experience a significant backlog, thereby delaying production of the trees. By omitting the longitudinal bore, BOP connector and/or wellhead hub connector, the present embodiment may be manufacturing in a greater number of facilities, thereby potentially decreasing manufacturing costs and production duration.

Figure 7:
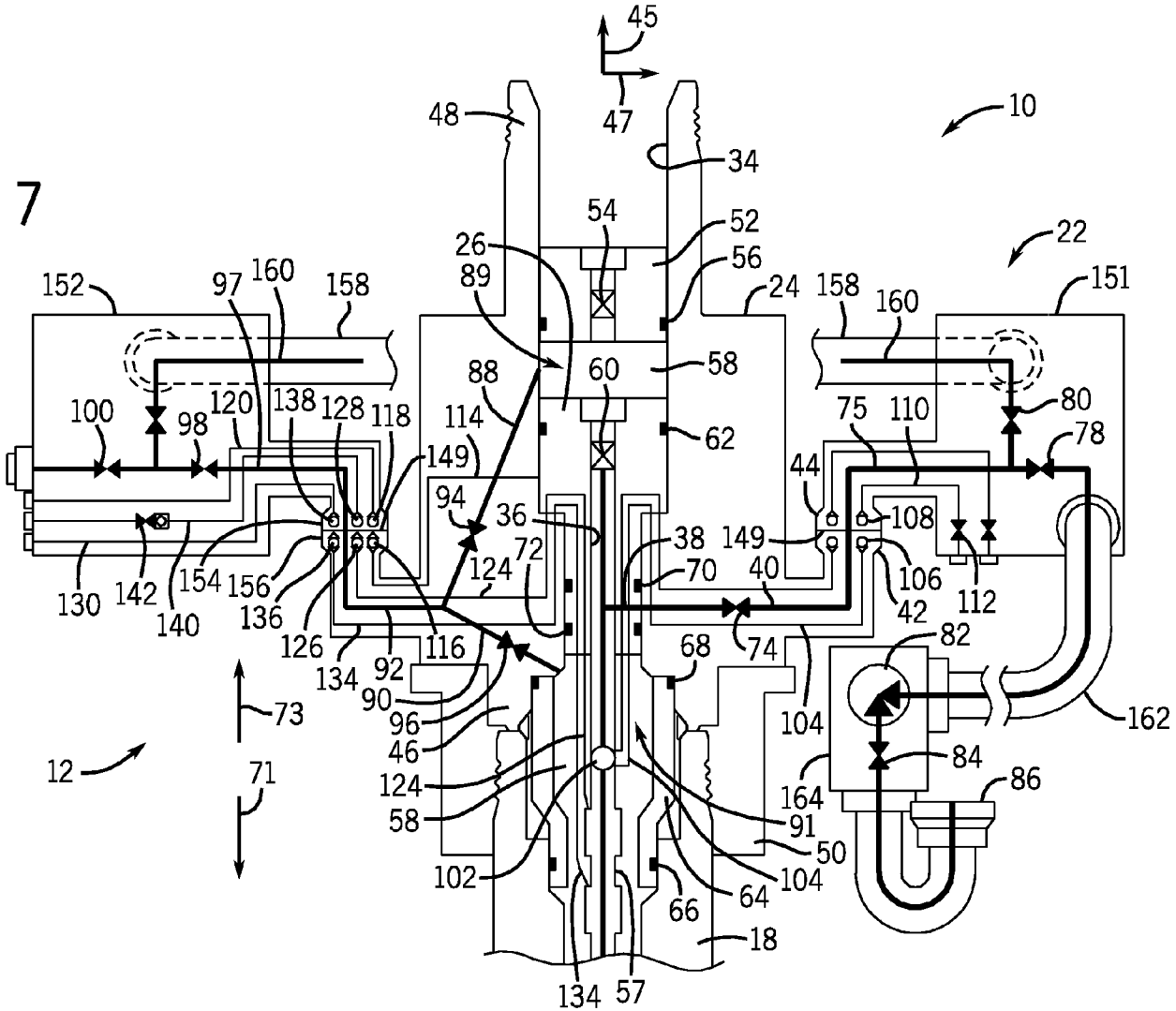
FIG. 7 is a cross-sectional side view of an embodiment of the tubing spool and subsea tree that may be used in the mineral extraction system of FIG.

FIG. 7 is a cross-sectional side view of an embodiment of the tubing spool 24 and subsea tree 22 that may be used in the mineral extraction system 10 of FIG. 1. In the present embodiment, the subsea tree 22 includes a structure that is circumferentially disposed about the tubing spool 24, as compared to the embodiments described above with reference to FIGS. 2-6 in which the subsea tree structure is positioned at one circumferential location radially outward from the tubing spool 24. As discussed in detail below, the structure of the subsea tree 22 may be substantially equally balanced in the radial direction 47, thereby facilitating the running and/or retrieval processes. In addition, because the valves may be positioned farther apart than the embodiments described above with reference to FIGS. 2-6, a remote operated vehicle (ROV) may have enhanced access to valve actuators.

In the present embodiment, the subsea tree 22 is separated into a production valve block 151 and an annulus valve block 152. As illustrated, both valve blocks 151 and 152 are disposed radially outward from the tubing spool 24, with each valve block located at a different circumferential position. As discussed in detail below, the production valve block 151 is supported by a frame that circumferentially extends about the tubing spool 24. In the present embodiment, the production valve block 151 includes the production flow passage 75 and the SCSSV hydraulic conduit 110, while the annulus valve block 152 includes the annulus flow passage 97, the vent/test conduit 120, the chemical injection conduit 130, and the sliding sleeve hydraulic conduit 140. However, it should be appreciated that the conduits 110, 120, 130 and 140 may be disposed within a different valve block in alternative embodiments. For example, in certain embodiments, the production valve block 151 may contain each of the conduits 110, 120, 130 and 140, while the annulus valve block 152 only includes the annulus flow passage 97. Alternatively, the annulus valve block 152 may contain each of the conduits 110, 120, 130 and 140, while the production valve block 151 only includes the production flow passage 75. It should be appreciated that corresponding lines extending from the subsea tree 22 to the surface may be connected to the appropriate valve block to establish a fluid connection with the conduits 110, 120, 130 and 140.

As illustrated, the production valve block 151 includes the mating hub connection 44 configured to interface with the hub connection 42. In the present embodiment, the hub connection 42 interfaces with the mating hub connection 44 along a plane 149 substantially perpendicular to the longitudinal bore 34 of the tubing spool 24. However, it should be appreciated that the hub connection 42 may interface with the mating hub connection 44 along a plane substantially parallel to the longitudinal bore 34 in alternative embodiments. As illustrated, the interface between the hub connection 42 and the mating hub connection 44 establishes fluid connections between the lateral flow passage 40 and the production flow passage 75, and between the SCSSV conduits 104 and 110.

Similarly, the annulus valve block 152 includes an annulus connector 154 configured to interface with an annulus hub 156 of the tubing spool 24. In the present embodiment, the annulus hub 156 interfaces with the annulus connector 154 along a plane 149 substantially perpendicular to the longitudinal bore 34 of the tubing spool 24. However, it should be appreciated that the annulus hub 156 may interface with the annulus connector 154 along a plane substantially parallel to the longitudinal bore 34 in alternative embodiments. As illustrated, the interface between the annulus hub 156 and the annulus connector 154 establishes fluid connections between the annulus lateral flow passage 92 and the annulus flow passage 97 within the subsea tree 22. In addition, connections are established between the vent/test conduits 114 and 120, between the chemical injection conduits 124 and 130, and between the sliding sleeve hydraulic conduits 134 and 140. Consequently, each conduit within the tubing spool 24 is fluidly coupled to a corresponding conduit with the subsea tree 22.

In the present embodiment, the subsea tree 22 includes an annulus crossover loop 158 extending between the annulus valve block 152 and the production valve block 151. As illustrated, the annulus crossover loop 158 contains an annulus conduit 160 extending between the annulus flow passage 97 and the annulus crossover valve 80, thereby establishing a fluid connection between the annulus 58 and the tubing string 57. The subsea tree 22 also includes a production flow loop 162 extending between the production valve block 151 and a production choke assembly 164. As illustrated, the production choke assembly 164 includes the choke 82 and the flowline isolation valve 84. The production flow loop 162 contains the production flow passage 75, thereby establishing a fluid connection between the production valve 78 and the choke 82. Furthermore, the flowline connection hub 86 is coupled to the choke assembly 164 to facilitate product flow from the subsea tree 22 to the surface. Because the components of the subsea tree 22 are circumferentially distributed about the tubing spool 24, the tree 22 may be substantially balanced, thereby facilitating running and retrieving operations. While a tree cap 52 is employed in the present embodiment, it should be appreciated that alternative embodiments may employ a tubing hanger 26 with a dual-plug configuration, such as the hanger 26 described above with reference to FIG. 3. Moreover, it should be appreciated that while plugs 54 and 60 are employed in the illustrated embodiment, alternative embodiments may utilize valves to selectively block product flow from exiting the tubing spool 24.

Figure 8:
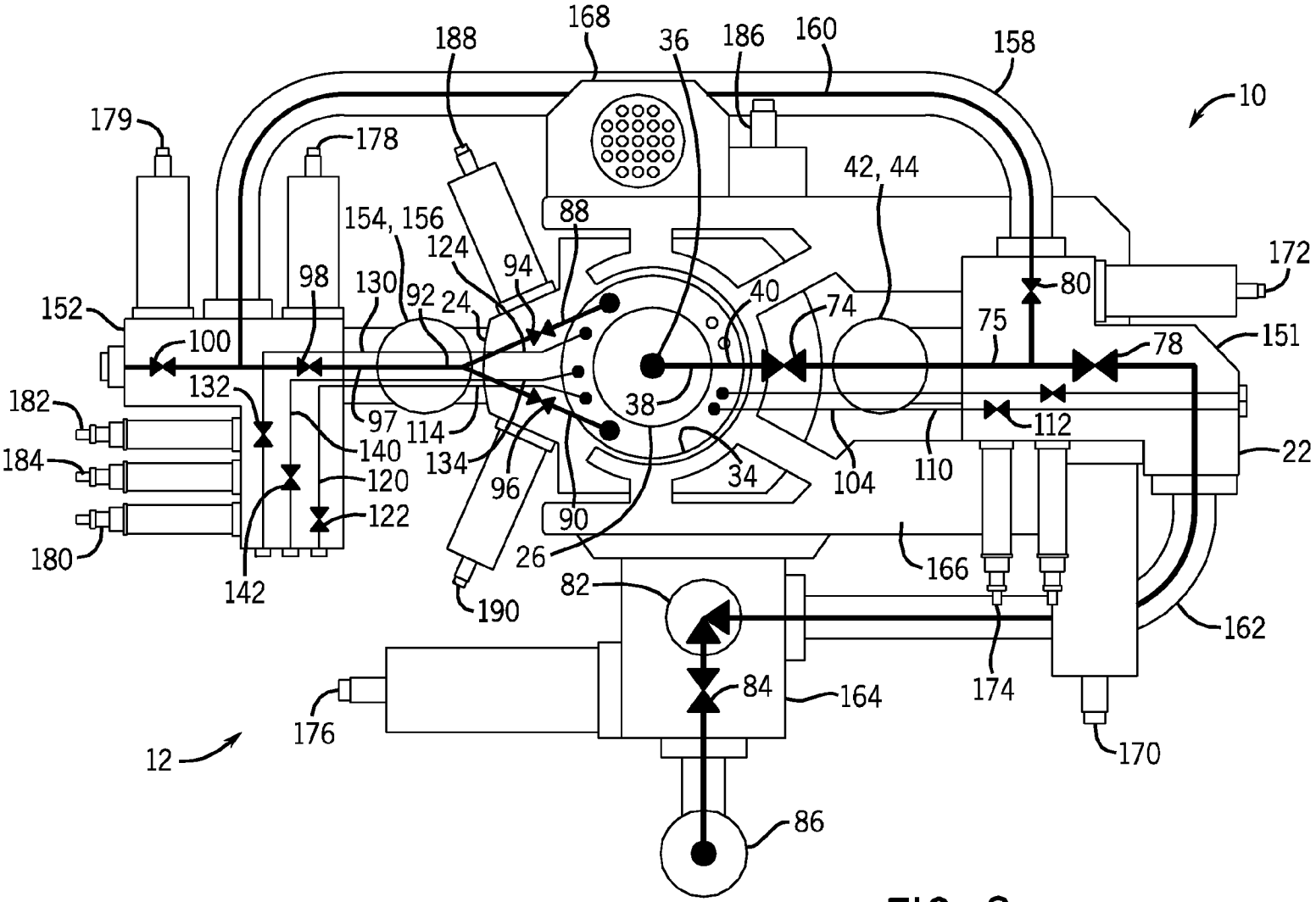
FIG. 8 is a top view of the tubing spool and subsea tree shown in FIG. 7.

FIG. 8 is a top view of the tubing spool 24 and subsea tree 22 shown in FIG. 7. As previously discussed, the subsea tree 22 includes a frame 166 circumferentially disposed about the tubing spool 24 and configured to support the production valve block 151. As illustrated, the frame 166 also supports the choke assembly 164 and an electronic control pod 168. In contrast, the annulus valve block 152 is supported by the annulus cross over loop 158 and the annulus connector 154. However, because the present annulus valve block 152 only includes a limited number of valves, the weight of the valve block 152 may not induce significant stress within the loop 158 or the connector 154. Because the structure of the subsea tree 22 is circumferentially disposed about the tubing spool 24, the subsea tree 22 may be substantially balanced, thereby facilitating running and retrieving operations.

In addition, because the valves are located in various circumferential positions within the subsea tree 22, an ROV may have enhanced access to valve actuators. For example, in the present embodiment, the production valve block 151 includes a production valve actuator 170 configured to control the production valve 78, an annulus crossover valve actuator 172 configured to control the annulus crossover valve 80, and an SCSSV valve actuator 174 configured to control the SCSSV valve 112. In addition, the choke assembly 164 includes a flowline isolation valve actuator 176 configured to control the flowline isolation valve 84. Furthermore, the annulus valve block 152 includes an annulus valve actuator 178 configured to control the annulus valve 98, an annulus monitor valve actuator 179 configured to control the annulus monitor valve 100, a vent/test valve actuator 180 configured to control the vent/test valve 122, a chemical injection valve actuator 182 configured to control the chemical injection valve 132, and a sliding sleeve valve actuator 184 configured to control the sliding sleeve valve 142. By circumferentially distributing the actuators about the tree 22, the ROV may readily access each actuator. In addition, the tubing spool 24 includes valve actuators configured to control the valves within the tubing spool 24. Specifically, the tubing spool 24 includes a production valve actuator 186 configured to control the production valve 74, an upper annulus valve actuator 188 configured to control the upper annulus valve 94, and a lower annulus valve actuator 190 configured to control the lower annulus valve 96.

Figure 9:
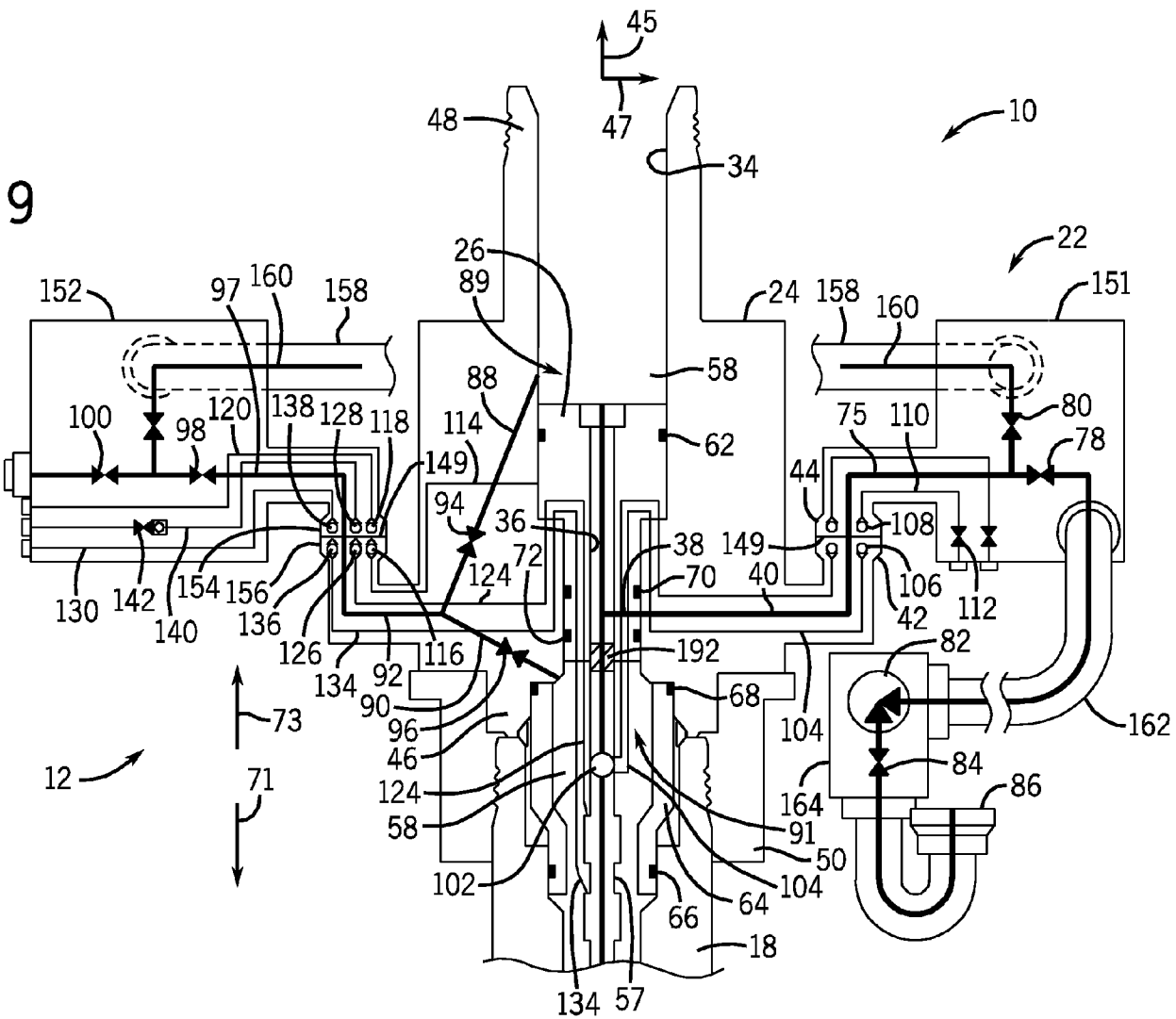
FIG. 9 is a cross-sectional side view of the tubing spool and subsea tree, as shown in FIG. 7, including a wireline plug.

FIG. 9 is a cross-sectional side view of the tubing spool 24 and subsea tree 22, as shown in FIG. 7, including a wireline plug 192 disposed in the longitudinal bore 36. As previously discussed, the valve 74 may be replaced with any suitable device configured to substantially block production flow from the well 16 to the hub connection 42. In the present embodiment, the wireline plug 192 is positioned below (i.e., upstream of) the lateral bore 38 such that the plug 192 serves to substantially block production flow through the longitudinal bore 36. Consequently, the valve 74 may be obviated. For example, in configurations without the valve 74, production flow from the well 16 may be substantially blocked by closing the SCSSV 102, and then landing the wireline plug 192 with a lightweight intervention vessel. Consequently, a dual barrier will be provided between the product and the environment. Similarly, if the valve 74 fails (e.g., becomes locked in the open position), the wireline plug 192 may be utilized until the tubing spool 24 is retrieved and the valve is repaired. While a wireline plug 192 is employed in the illustrated embodiment, it should be appreciated that alternative embodiments may utilize a valve coupled to the tubing hanger 26 and disposed within the longitudinal bore 36 to selectively block production flow from the well 16 to the hub connection 42.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system for producing well production fluids through a tubing hanger connected with a tubing string, comprising:

a subsea tree comprising a structure comprising:

a production flow passage; and a production valve to control production fluid flow through the production flow passage;

a tubing spool comprising:

a body comprising a longitudinal bore configured to receive and support the tubing hanger; and a lateral production flow passage extending from the longitudinal bore and configured to transfer production fluids to the subsea tree production flow passage;

wherein the subsea tree structure is separate and located spatially apart from the tubing spool body such that the subsea tree does not block a subsea intervention or blowout preventer (BOP) connection to the tubing spool longitudinal bore.

2. The system of claim 1, wherein the subsea tree and the tubing spool are independently retrievable.

3. The system of claim 1, comprising the tubing hanger, wherein the tubing hanger is configured to support a tubing string and to direct the product from the tubing string into the lateral production flow passage, and wherein the subsea tree and the tubing hanger are independently retrievable.

4. The system of claim 1, wherein the subsea tree does not include a wellhead connection.

5. The system of claim 1, wherein the structure of the subsea tree is positioned at one circumferential region radially outward from the tubing spool longitudinal bore.

6. The system of claim 5, wherein the tubing spool comprises a hub connection extending laterally outward past the tubing spool body and comprising a hub configured to interface with a corresponding hub connection comprising a hub on the subsea tree to transfer product between the lateral production flow passage and the subsea tree.

7. The system of claim 6, wherein the hub connection is configured to interface with the mating hub connection along a plane substantially perpendicular to an axis of the longitudinal bore.

8. The system of claim 6, wherein the hub connection is configured to interface with the mating hub connection along a plane substantially parallel to an axis of the longitudinal bore.

9. The system of claim 6, wherein the hub connection and the mating hub connection each comprise respective conduits configured to transfer liquid to an annulus, a subsurface safety valve, a chemical injection conduit, or a combination thereof.

10. The system of claim 1, wherein the structure of the subsea tree is circumferentially disposed about the tubing spool.

11. A system comprising a tubing spool for use with a tubing hanger and a subsea tree comprising a hub connection, comprising:

a body comprising a longitudinal bore configured to receive and support the tubing hanger;

a hub connection extending laterally outward past the longitudinal bore and comprising a hub;

a lateral production flow passage extending from the longitudinal bore and through the hub connection; and wherein the hub connection is configured to interface with the hub of the subsea tree hub connection to communicate production fluids to the subsea tree though the lateral production flow passage.

12. The system of claim 11, wherein the tubing hanger is configured to direct a flow of production fluid from the tubing string into the lateral production flow passage.

13. The system of claim 12, wherein the subsea tree is separate and positioned radially outward from the tubing spool body such that the subsea tree and the tubing hanger are independently retrievable.

14. The system of claim 13, wherein the subsea tree and the tubing spool are independently retrievable.

15. A system for producing well production fluids, comprising:

a subsea tree comprising a structure comprising:

a production flow passage;

a production valve to control production fluid flow through the production flow passage;

a mating hub connection comprising a hub and configured to receive production fluids;

a tubing spool comprising:

a body comprising an end configured to interface with a blowout preventer (BOP);

a first longitudinal bore;

a hub connection comprising a hub extending laterally outward past the tubing spool body and configured to output the production flow to the subsea tree; and a first lateral production flow passage extending between the longitudinal bore and the hub connection, wherein the hub connection is configured to interface with the mating hub connection;

a tubing hanger disposed and supported within the tubing spool longitudinal bore, wherein the tubing hanger comprises a second longitudinal bore and a second lateral production flow passage in fluid communication with the second longitudinal bore, and wherein the second lateral production flow passage is in fluid communication with the first lateral production flow passage to establish a production flow path between the second longitudinal bore and the hub connection;

wherein the subsea tree structure is separate and located spatially apart from the tubing spool body; and wherein the tubing hanger and the subsea tree are configured to be run and retrieved independently of one another.

16. The system of claim 15, comprising a tree cap disposed within the first longitudinal bore between the tubing hanger and the end, wherein the tree cap is configured to block the production flow out of the tubing spool.

17. The system of claim 15, comprising a plug disposed within the second longitudinal bore downstream from the second lateral flow passage, wherein the plug is configured to block the production flow out of the tubing hanger.

18. The system of claim 15, wherein the subsea tree is positioned radially outward from the tubing spool first longitudinal bore.

19. The system of claim 15, wherein the hub connection is configured to interface with the mating hub connection along a plane substantially perpendicular or substantially parallel to an axis of the first longitudinal bore.

20. The system of claim 15, comprising a plug disposed within the second longitudinal bore upstream of the second lateral production flow passage, wherein the plug is configured to block production flow to the hub connection.

21. The system of claim 15, wherein the subsea tree and the tubing spool are retrievable independently from one another.

22. The system of claim 1, wherein the subsea tree does not comprise a longitudinal bore sized for receiving the tubing hanger.

* * * * *